US009109341B1

(12) United States Patent
Shin

(10) Patent No.: US 9,109,341 B1
(45) Date of Patent: Aug. 18, 2015

(54) GROUND ANCHOR BODY HAVING ROTATION RELEASE STRUCTURE

(71) Applicant: Samjin Steel Ind. Co., Ltd., Gimpo-si, Gyeonggi-do (KR)

(72) Inventor: Hyun Taek Shin, Bucheon-si (KR)

(73) Assignee: SAMJIN STEEL IND. CO., LTD., Gimpo-si, Gyeonggi-do (KR)

( * ) Notice: Subject to any disclaimer, the term of this patent is extended or adjusted under 35 U.S.C. 154(b) by 0 days.

(21) Appl. No.: 14/612,147

(22) Filed: Feb. 2, 2015

(30) Foreign Application Priority Data

Feb. 4, 2014 (KR) ..... 10-2014-0012700

(51) Int. Cl.
*E02D 5/80* (2006.01)
*E02D 5/54* (2006.01)

(52) U.S. Cl.
CPC ... *E02D 5/80* (2013.01); *E02D 5/54* (2013.01)

(58) Field of Classification Search
CPC ..... E02D 5/54; E02D 5/80
USPC ..... 52/155, 156, 162, 165; 405/231, 244, 405/259.1; 428/156
See application file for complete search history.

(56) References Cited

U.S. PATENT DOCUMENTS 1,907,811 A * 5/1933 Hollos ..... 52/156
2,343,350 A * 3/1944 Warren ..... 52/156
3,371,494 A * 3/1968 Lagerstrom ..... 405/259.5
4,502,258 A * 3/1985 Rushing ..... 52/103
4,592,178 A * 6/1986 Lu ..... 52/155
4,697,394 A * 10/1987 Lu ..... 52/162
5,067,854 A * 11/1991 Sweeney ..... 405/184
5,572,949 A * 11/1996 Bryant et al. ..... 119/57.91
5,899,640 A * 5/1999 Yeh ..... 405/259.1
2005/0141969 A1* 6/2005 Gregory et al. ..... 405/230
2010/0266345 A1* 10/2010 Hinton et al. ..... 405/259.1
2012/0014756 A1* 1/2012 Cai et al. ..... 405/259.1
2012/0192508 A1* 8/2012 Burdine et al. ..... 52/155
2013/0149041 A1* 6/2013 Steyn ..... 405/259.1
2014/0154017 A1* 6/2014 Hidalgo Salgado ..... 405/259.1

* cited by examiner

*Primary Examiner* — Jeanette E Chapman
*Assistant Examiner* — James Buckle, Jr.
(74) *Attorney, Agent, or Firm* — Novick, Kim & Lee, PLLC; Jae Youn Kim

(57) ABSTRACT

Disclosed herein is a ground anchor body having a rotation release structure. The ground anchor body includes a waterproof cap, a head coupler, a wedge, a tubular guide, a movable body, and a compression spring. The head coupler is coupled to a lower end of the waterproof cap. A tapered hole is longitudinally formed in the head coupler. The wedge is disposed in a tapered hole of the head coupler to hold the PC strand. The guide is installed in the waterproof cap. A slide slot is longitudinally formed in the guide. The movable body is disposed in the guide and provided with a slide protrusion inserted into the slide slot. The wedge is coupled to the movable body, and a key depression is formed in the movable body so that an end of the PC strand is key-coupled to the movable body. The compression spring elastically compresses the movable body downward.

1 Claim, 11 Drawing Sheets

GROUND ANCHOR BODY HAVING ROTATION RELEASE STRUCTURE

BACKGROUND OF THE INVENTION

1. Field of the Invention

The present invention generally relates to removable ground anchor bodies using springs. More particularly, the present invention relates to a ground anchor body having a rotation release structure configured such that a PC strand, a deformed bar or the like coupled to the anchor body can be reliably maintained in the coupled state, and when needed, the PC strand, the deformed art or the like can be easily separated and removed from the anchor body.

2. Description of the Related Art

Generally, slope reinforcement structures provided with PC strands, deformed bars or the like are formed by a method including: forming a bore in the ground; inserting a tension member having a high tensile strength with an internal fixer and an anchor body into the bore; injecting grouting material such as concrete or the like to firmly fix the tension member in place; and applying a load to a free end of the tension member and fixing the free end in place using an external fixer to prove sufficient fixing force. Such slope reinforcement structures structure to stably support structures such as retaining walls and are widely used in works for preventing loss of earth and sand from a section of soft ground or in sheathing works for preventing collapse of the peripheral ground during an excavation work for underground structures in construction or civil engineering works.

Tension members used for such slope reinforcement structures are produced by twisting several deformed bars or steel wires. Such deformed bars or tension members have high strength, but if they are left on the ground they may act as obstacles causing problems pertaining to indemnification or the like when neighboring areas are developed later.

To avoid the above-mentioned problems, an internal fixer for removable ground anchors was proposed. This internal fixer is configured such that deformed bars or tension members that have been embedded in the ground can be easily removed after the construction has been completed.

Such a conventional anchor body includes: a cylindrical body with an inclined surface formed in the cylindrical body; a wedge that is disposed on the inclined surface of the body and divided into about three parts, with a tension member disposed in a central space among the three parts; and an elastic spring provided on a rear end of the wedge to elastically compress the wedge forward and prevent the tension member from being undesirably displaced or removed.

In the structure of this conventional anchor body, when needed, the tension member can be removed, after the tension member is compressed and the wedge disposed in the cylindrical body is moved backward while the central space among the parts of the wedge is expanded. However, even after the wedge is moved backward, the central space of the wedge may not be reliably expanded. Although the wedge is moved backward and the central space of the wedge is expanded, the spring continuously compresses the rear end of the wedge, thus making it difficult to remove the tension member from the anchor body, whereby the tension member may be reliably separated from the anchor body.

Furthermore, in the case of the conventional removable internal fixer, if a shock is applied to the internal fixer for PC strands when transporting a PC strand produced from a factory to a construction site or conducting a construction work, the tension member may not be easily removed later.

Moreover, if the anchor body that has been in the coupled state is undesirably separated by an external shock, it is almost impossible to reassemble the anchor body in a construction site, thus disrupting the progress of the construction.

In an effort to overcome the above problems, another conventional technique was introduced in Korean Patent Registration No. 10-0963565, filed by the applicant of the present invention.

SUMMARY OF THE INVENTION

Accordingly, the present invention has been made keeping in mind the above problems occurring in the prior art, and an object of the present invention is to provide a ground anchor body having a rotation release structure that is configured to appropriately cope with movement of the ground and maximize the support force, wherein a PC strand, a deformed bar or the like coupled to the anchor body can be easily separated and removed from the anchor body when needed, and the coupling of the PC strand, the deformed bar or the like to the anchor body can be reliably maintained even when an external shock is applied thereto in a construction site or during a process of transporting the anchor body, whereby the product reliability can be enhanced.

In order to accomplish the above object, the present invention provides a ground anchor body having a rotation release structure, including: a waterproof cap having a hollow structure; a head coupler coupled to a lower end of the waterproof cap, with a tapered hole longitudinally formed in the head coupler so that a PC strand is inserted into the tapered hole; a wedge disposed in the tapered hole of the head coupler, the wedge holding the PC strand; a tubular guide installed in the waterproof cap, with at least one slide slot longitudinally formed in the guide; a movable body installed in the guide and including at least one slide protrusion inserted into the slide slot, the movable body being coupled at a lower end thereof to the wedge, with a key depression formed in a central portion of a lower surface of the movable body so that an upper end of the PC strand is key-coupled to the movable body; and a compression spring elastically biasing the movable body downward.

BRIEF DESCRIPTION OF THE DRAWINGS

The above and other objects, features and advantages of the present invention will be more clearly understood from the following detailed description taken in conjunction with the accompanying drawings, in which:

FIGS. 6A through 6E are sectional views successively showing the operation of the ground anchor body having a rotation release structure according to the embodiment of the present invention, wherein FIG. 6A is a sectional view showing the coupling a PC strand to the anchor body, FIG. 6B is a sectional view showing the PC strand that is being pushed, FIG. 6C is a sectional view showing the PC strand when completely pushed, FIG. 6D is a sectional view showing rotation of the PC strand, and FIG. 6E is a sectional view showing the PC strand removed from the anchor body.

Figure 1:
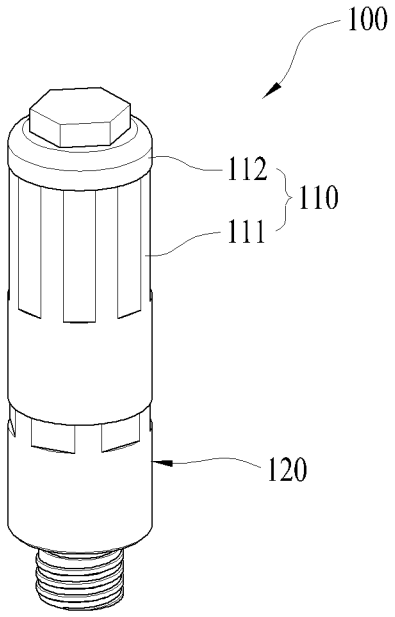
FIG. 1 is a perspective view illustrating a ground anchor body having a rotation release structure according to an embodiment of the present invention.

<Description of the Reference Numerals in the Drawings>

10: PC strand or deformed bar
100: anchor body
111: first waterproof cap part
112: second waterproof cap part
113: guide depression
121: tapered hole
130: wedge
140: guide
142: operation space
151: slide protrusion
153: connection means
160: compression spring
110: waterproof cap
120: head coupler
122: locking protrusion
131: connection means
141: slide slot
150: movable body
152: key depression
154: guide depression

DESCRIPTION OF THE PREFERRED EMBODIMENTS

Hereinafter, an embodiment of the present invention will be described in detail with reference to the attached drawings.

Figure 2:
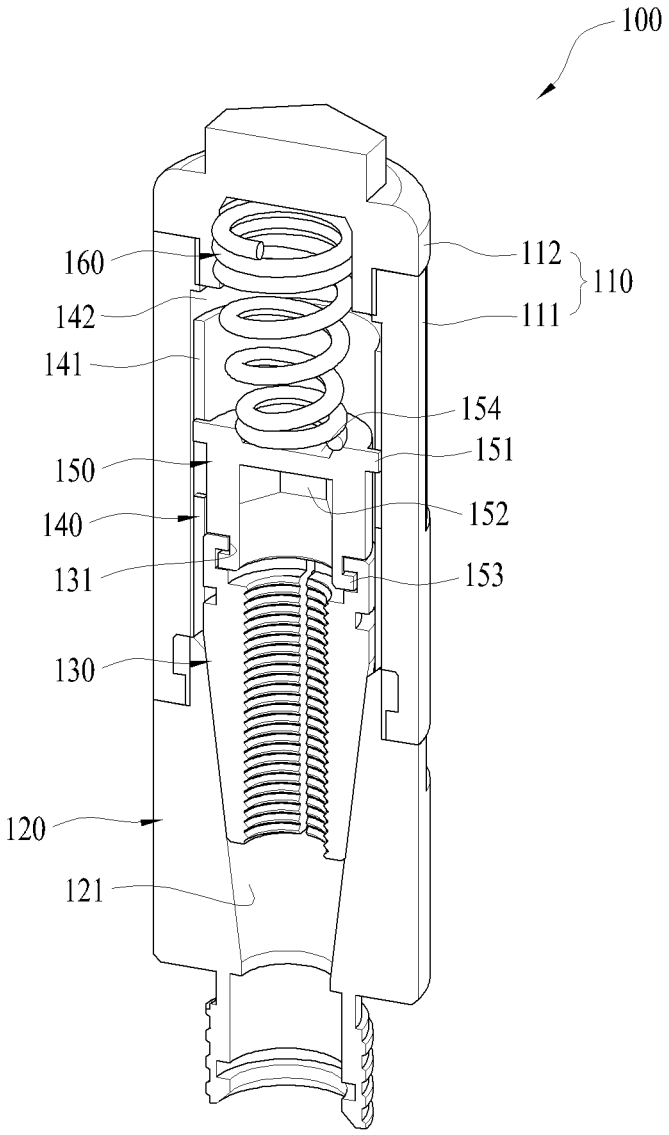
FIG. 2 is a perspective sectional view illustrating the ground anchor body having a rotation release structure according to the embodiment of the present invention.
Figure 3:
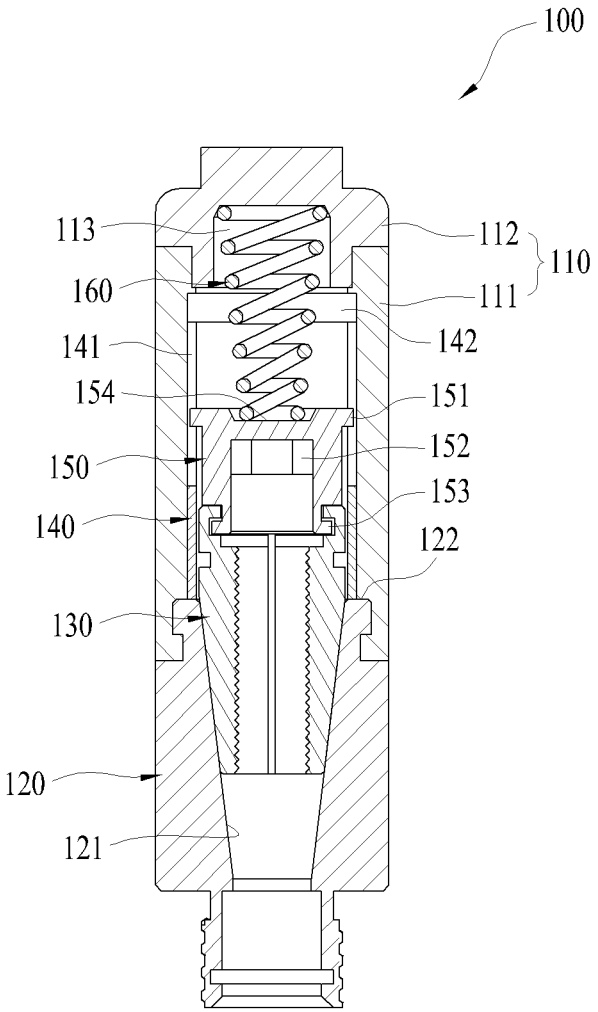
FIG. 3 is a sectional view illustrating the ground anchor body having a rotation release structure according to the embodiment of the present invention.
Figure 4:
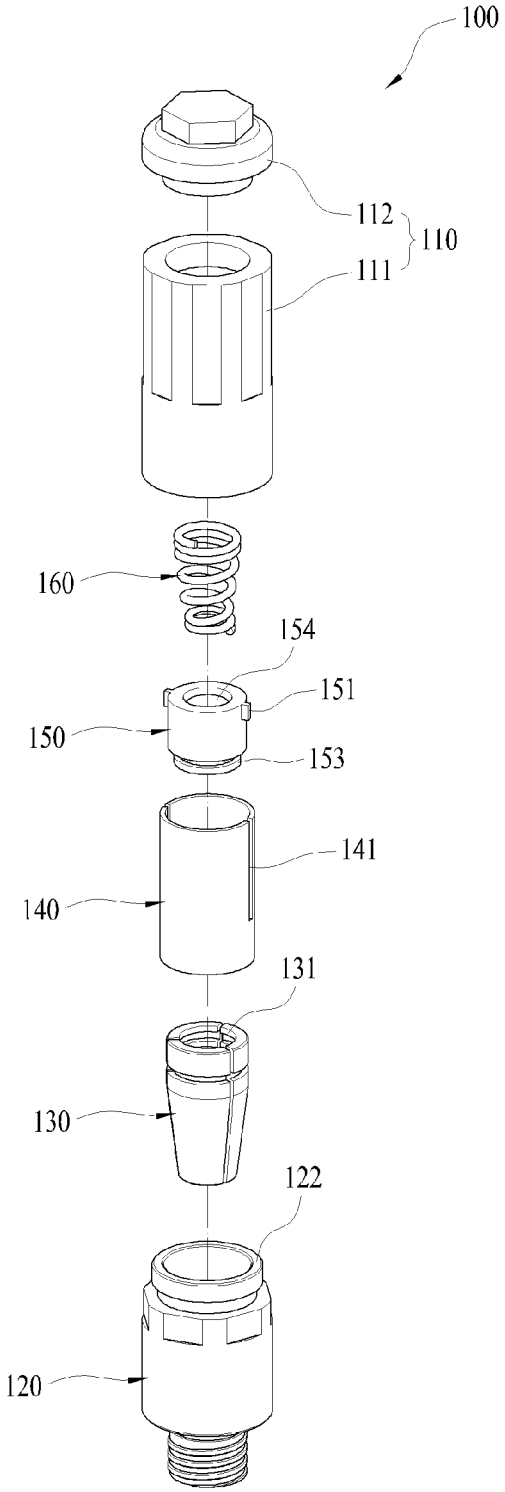
FIG. 4 is an exploded perspective view illustrating the ground anchor body having a rotation release structure according to the embodiment of the present invention.
Figure 5:
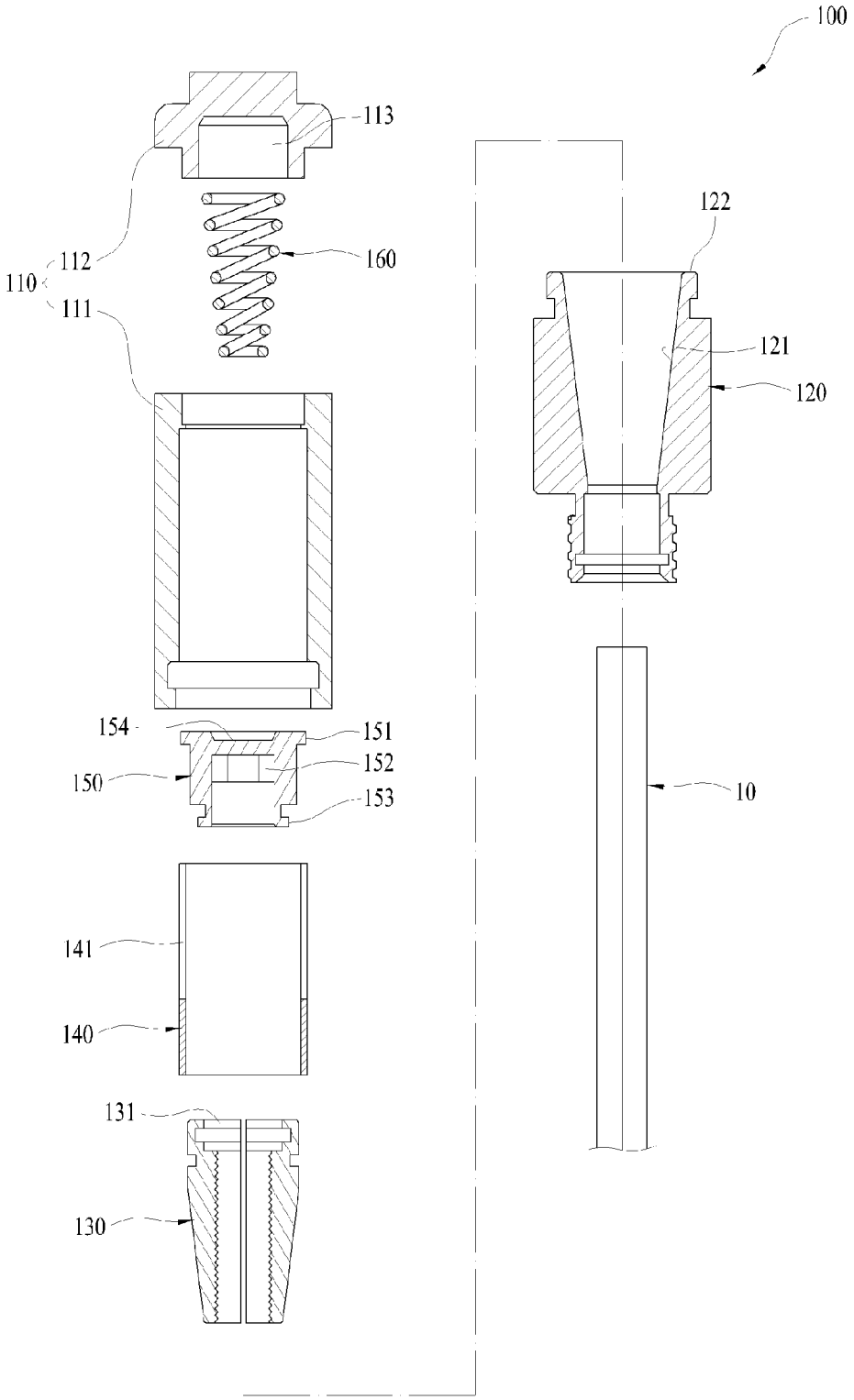
FIG. 5 is an exploded sectional view illustrating the ground anchor body having a rotation release structure according to the embodiment of the present invention.
Figure 6A:
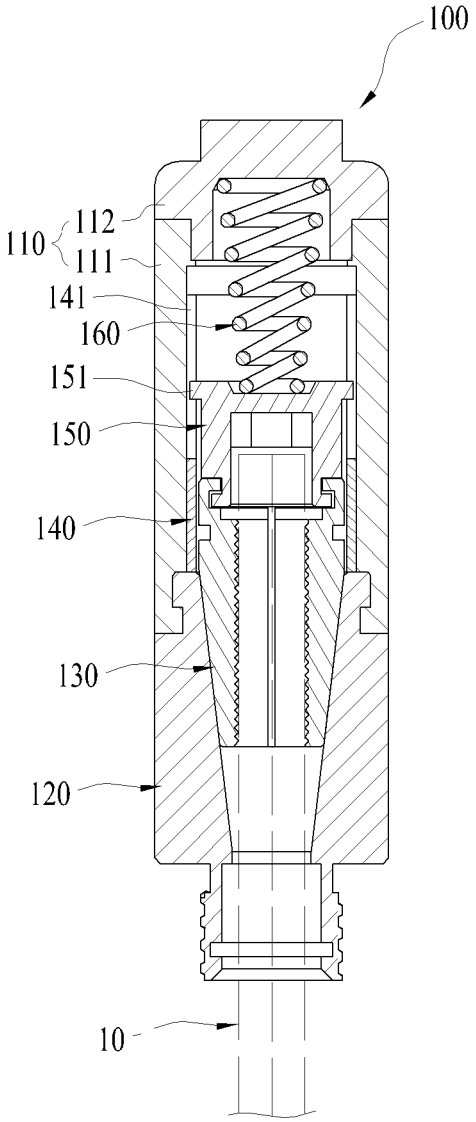
Figure 6B:
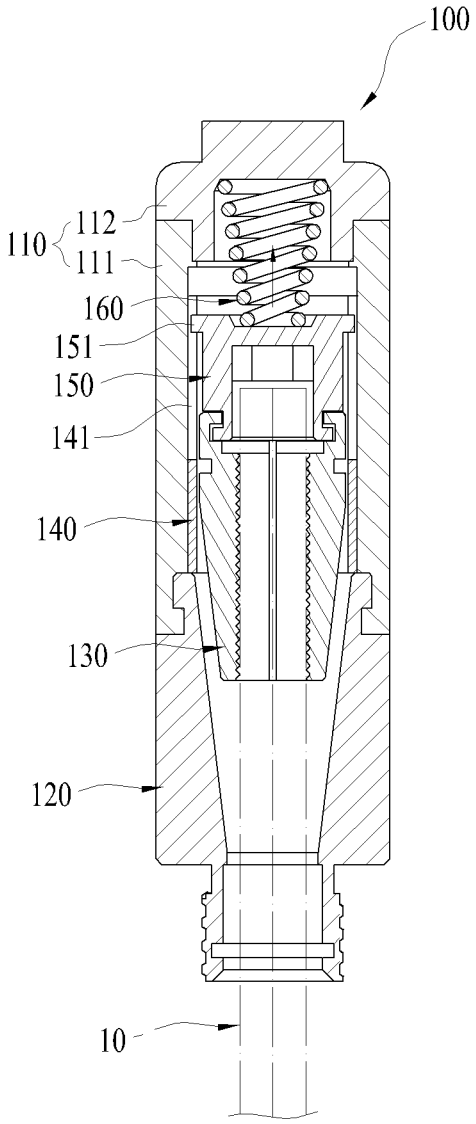
Figure 6C:
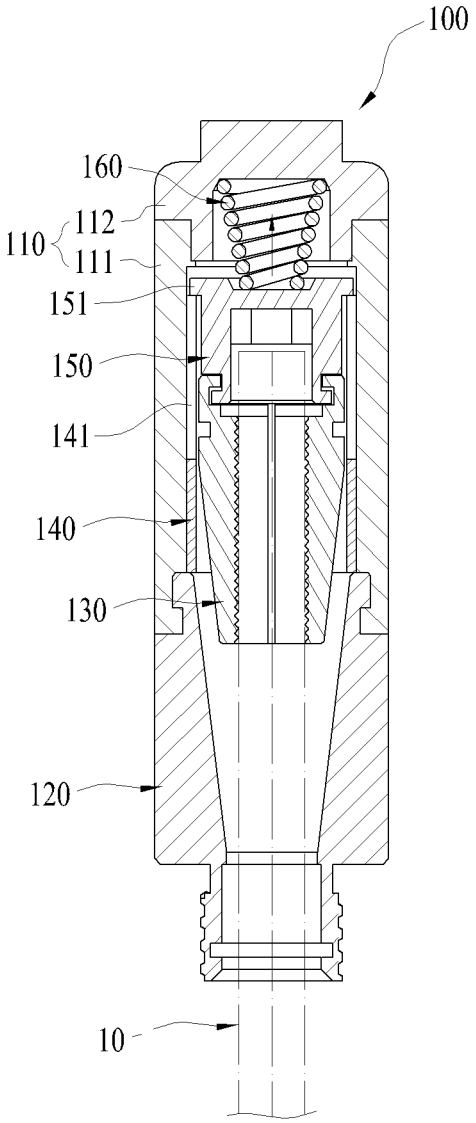
Figure 6D:
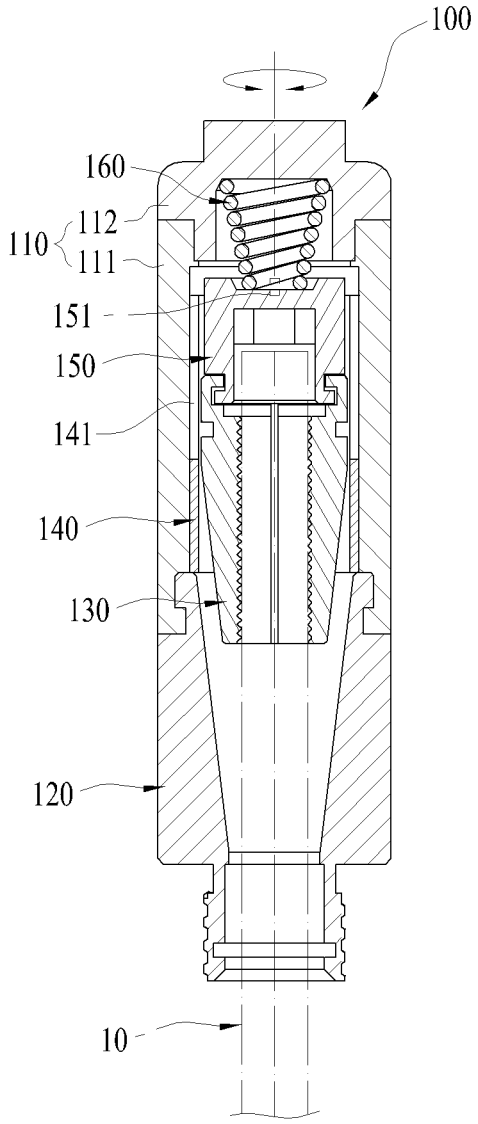
Figure 6E:
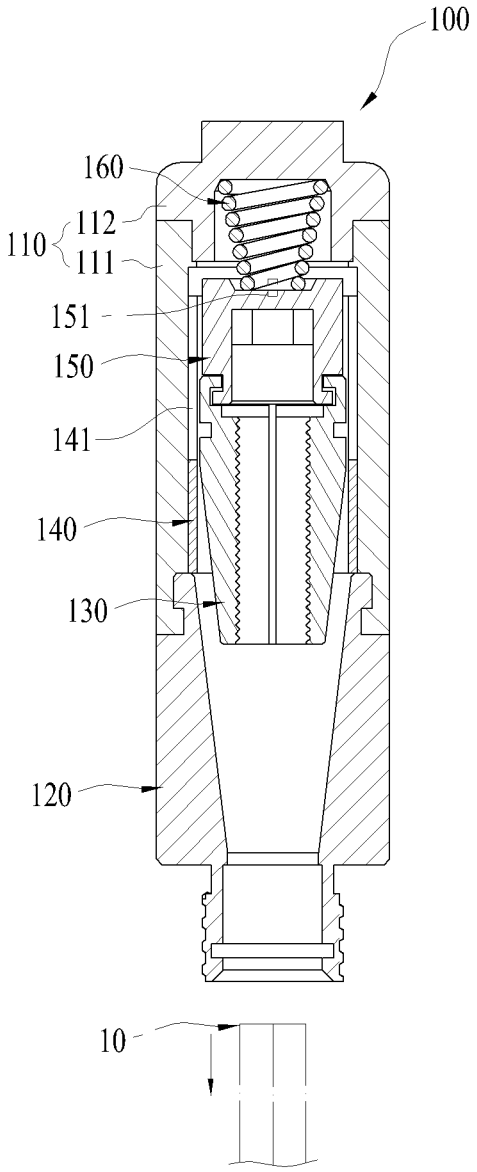
Figure 7:
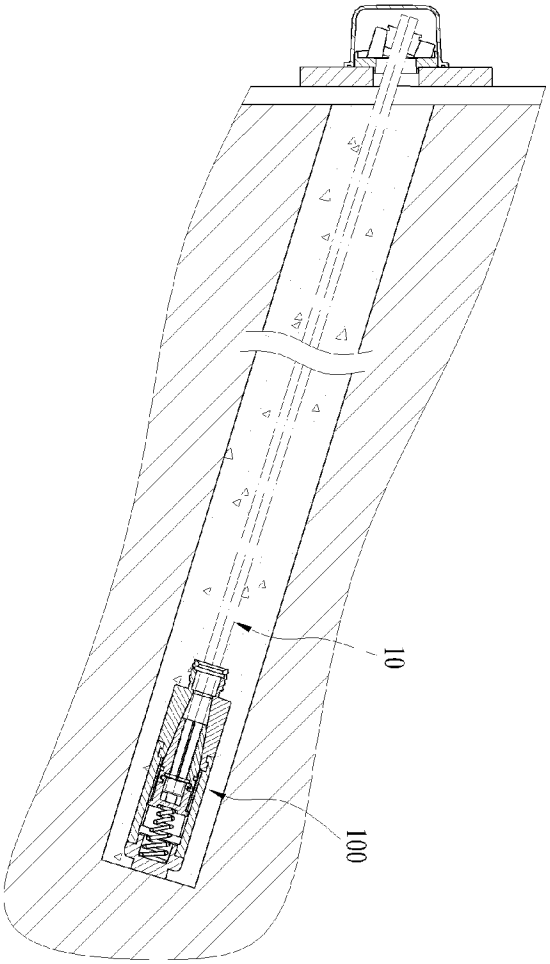
FIG. 7 is a sectional view showing installation of the ground anchor body having a rotation release structure according to the embodiment of the present invention.

As shown in FIGS. 1 through 7, a ground anchor body 100 having a rotation release structure according to the embodiment of the present invention includes a waterproof cap 110, a head coupler 120, a wedge 130, a guide 140, a movable body 150, and a compression spring 160. The waterproof cap 110 has a hollow structure. The head coupler 120 is coupled to a lower end of the waterproof cap 110. A tapered hole 121 is longitudinally formed in the head coupler 120 so that a prestressed concrete (PC) strand 10 is inserted into the head coupler 120 through the tapered hole 121. The wedge 130 is disposed in the tapered hole 121 of the head coupler 120 so as to hold the PC strand 10. The guide 140 is installed in the waterproof cap 110 and has a tubular shape. At least one slide slot 141 is longitudinally formed in the guide 140. The movable body 150 is installed in the guide 140 and includes a slide protrusion 151 inserted into the slide slot 141. A lower end of the movable body 150 is coupled to the wedge 130. A key depression 152 is formed in a central portion of a lower surface of the movable body 150 so that an upper end of the PC strand 10 is key-coupled to the movable body 150. The compression spring 160 is provided to elastically compress and bias the movable body 150 downward.

The waterproof cap 110 includes a first waterproof cap part 111 having a tubular shape, and a second waterproof cap part 112 that is coupled to the first waterproof cap part 111 and covers an upper end of the first waterproof cap part 111. A guide depression 113 is formed in the second waterproof cap part 112, and an upper end of the compression spring 160 is fitted into the guide depression 113.

The head coupler 120 is coupled to a lower end of the first waterproof cap part 111 of the waterproof cap 110. Preferably, a locking protrusion 122 is provided on an upper end of the head coupler 120 so that when the head coupler 120 is coupled to the first waterproof cap part 111, a lower end of the guide 140 is stopped by the locking protrusion 122 of the head coupler 120.

The wedge 130 is divided into three parts in the longitudinal direction. A connection means 131 is formed on an upper end of the wedge 130 in a general shape having both a protrusion and a depression.

In this embodiment, the slide slots 141 are respectively and longitudinally formed in left and right portions of the guide 140. The guide 140 is inserted into the first waterproof cap part 111 of the waterproof cap 110 in such a way that the guide 140 comes into contact with an inner circumferential surface of the first waterproof cap part 111. The lower end of the guide 140 is stopped by and supported on the locking protrusion 122 provided on the upper end of the head coupler 120. An operation space 142 is formed above the upper end of the guide 140.

The operation space 142 is formed by making the guide 140 be shorter than the inner circumferential surface of the first waterproof cap part 111.

The guide 140 may be integrally formed in the first waterproof cap part 111 with the operation space 142 and the slide slots 141 formed in the above-mentioned manner.

The movable body 150 has in a lower end thereof a connection means 153 that includes a protrusion and a depression that are coupled to the connection means 131 of the wedge 130. In this embodiment, two slide protrusions 151 are respectively provided on left and right portions of the movable body 150 and inserted into the respective slide slots 141 of the guide 140. Furthermore, the key depression 152 is formed in the lower surface of the movable body 150, and the upper end of the PC strand or deformed bar 10 is inserted into the key depression 152 for key-coupling such that the movable body 150 can be rotated interlocking with the PC strand or deformed bar 10.

A guide depression 154 is formed in an upper surface of the movable body 150 so as to guide a lower end of the compression spring 160, whereby the movable body 150 can be effectively compressed downward by the spring 160.

The operation of the ground anchor body 100 according to the present invention will be described below.

First, the PC strand or deformed bar 10 is inserted into the tapered hole 121 of the head coupler 120 such that the front end of the PC strand or deformed bar 10 is fitted into the key depression 152 of the movable body 150. In this state, because the movable body 150 is continuously compressed by the compression spring 160, the wedge 130 is wedged into the tapered hole 121 of the head coupler 120 and maintained in the wedged state. Consequently, the PC strand or deformed bar 10 can be strongly maintained in the coupled state so that even if a shock is applied thereto while transporting or unloading, the coupled state can be reliably maintained.

Subsequently, the anchor body 100 coupled to the PC strand or deformed bar 10 in the above-mentioned manner is inserted into a bore. Thereafter, various slope reinforcement works can be conducted.

Particularly, in the anchor body 100 according to the present invention, after a grouting process has been conducted, the PC strand or deformed bar 10 can be removed as follows. When the PC strand or deformed bar 10 is pushed into the bore, the slide protrusions 151 of the movable body 150 are moved forward along the slide slots 141 of the guide 140 and enter the operation space 142. In this state, when the PC strand or deformed bar 10 is rotated to 90°, the movable body 150 is rotated interlocking with the PC strand or deformed bar 10, and the slide protrusions 151 are locked to the upper end of the guide 140 so that the movable body 150 that has been moved forward can be maintained in place regardless of the elastic force of the compression spring 160.

Furthermore, when the movable body 150 is moved forward, the wedge 130 coupled to the lower end of the movable body 150 is also moved forward out of the tapered hole 121 of the head coupler 120, thus releasing the PC strand or deformed bar 10. Thereafter, when the PC strand or deformed bar 10 is pulled, it can be easily removed from the bore.

As described above, the present invention provides a ground anchor body having a rotation release structure. In the ground anchor body, a wedge is biased toward the head coupler by a compression spring so that the wedge is wedged into a tapered hole of the head coupler and continuously maintained in the wedged state. Therefore, even if a shock is applied to the anchor body while transporting or unloading it, the coupled state can be reliably maintained. As needed, when a PC strand or deformed bar is pushed, a slide protrusion is moved forward along a slide slot of a guide and enters an operation space. In this state, when the PC strand or deformed bar is rotated to 90°, the slide protrusion is locked to an upper end of the guide. In this way, when needed, the PC strand or deformed bar can be easily released from the wedge and removed from a bore. As such, the PC strand, the deformed bar or the like coupled to the anchor body can be easily separated and removed from the anchor body when needed. The coupling of the PC strand, the deformed bar or the like to the anchor body can be reliably maintained even when an external shock is applied thereto in a construction site or during a process of transporting the anchor body. Consequently, the product reliability can be enhanced.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A ground anchor body having a rotation release structure, comprising:

a waterproof cap including a first waterproof cap part having a tubular shape, and a second waterproof cap part coupled to the first waterproof cap part, the second waterproof cap part covering an upper end of the first waterproof cap part, with a first guide depression formed in the second waterproof cap part, and a compression spring inserted at an upper end thereof into the first guide depression;

a head coupler coupled to a lower end of the first waterproof cap part of the waterproof cap, the head coupler including a locking protrusion on an upper end thereof, with a tapered hole longitudinally formed in the head coupler so that a PC (prestressed concrete) strand is inserted into the tapered hole;

a wedge disposed in the tapered hole of the head coupler, the wedge holding the PC strand;

a tubular guide installed in the waterproof cap, with at least one slide slot longitudinally formed in the tubular guide, wherein the tubular guide is inserted into the first waterproof cap part of the waterproof cap in such a way that the tubular guide comes into contact with an inner circumferential surface of the first waterproof cap part, a lower end of the tubular guide is stopped by the locking protrusion provided on the upper end of the head coupler, and an operation space is formed above the tubular guide;

a movable body installed in the tubular guide and including at least one slide protrusion inserted into the at least one slide slot, the movable body being coupled at a lower end thereof to the wedge, with a key depression formed in a central portion of a lower surface of the movable body so that an upper end of the PC strand is key-coupled to and interlocked with the movable body, and with a second guide depression formed in an upper surface of the movable body; and a compression spring installed in the second waterproof cap part of the waterproof cap, the compression spring elastically biasing the movable body downward.

* * * * *